US010947746B2

(12) United States Patent
White

(10) Patent No.: US 10,947,746 B2
(45) Date of Patent: Mar. 16, 2021

(54) CONFIGURABLE STEEL FORM SYSTEM FOR FABRICATING PRECAST PANELS

(71) Applicant: MW Panel Tech, LLC, Fort Worth, TX (US)

(72) Inventor: Jonathan White, Hurst, TX (US)

(73) Assignee: MW Panel Tech, LLC, Fort Worth, TX (US)

( * ) Notice: Subject to any disclaimer, the term of this patent is extended or adjusted under 35 U.S.C. 154(b) by 117 days.

(21) Appl. No.: 16/123,744

(22) Filed: Sep. 6, 2018

(65) Prior Publication Data

US 2020/0080326 A1 Mar. 12, 2020

(51) Int. Cl.
*B28B 7/00* (2006.01)
*E04G 11/00* (2006.01)

(52) U.S. Cl.
CPC ..... *E04G 11/00* (2013.01)

(58) Field of Classification Search
CPC ..... E04G 2017/008; B28B 7/0014; B28B 7/0017; B28B 7/0026
USPC ..... 249/6, 192, 208, 2, 3, 4, 5, 7, 8, 139, 249/160, 168
See application file for complete search history.

(56) References Cited

U.S. PATENT DOCUMENTS 706,410 A * 8/1902 Harrop ..... E01C 19/504 249/9
1,329,177 A * 1/1920 Heltzel ..... B28B 7/0017 249/3
1,527,698 A * 2/1925 Pearthree ..... E01C 19/502 249/7
1,615,178 A * 1/1927 Moss ..... E01C 19/506 249/8
1,658,255 A 2/1928 Rhoads
1,944,511 A * 1/1934 Heltzel ..... E01C 19/502 249/6

(Continued)

FOREIGN PATENT DOCUMENTS

AU 2011204783 A1 2/2012
CN 109531784 A * 3/2019 ..... B28B 7/0017

(Continued)

OTHER PUBLICATIONS

Translation of CN 109531784-A; Mar. 29, 2019. (Year: 2019).*
PCT/US19/49017 International Search Report, 2 pages, dated Nov. 21, 2019.

*Primary Examiner* — Michael Safavi
(74) *Attorney, Agent, or Firm* — Whitaker Chalk Swindle & Schwartz PLLC; Enrique Sanchez; Carder Brooks

(57) ABSTRACT

A configurable steel form system for creating precast concrete panels is disclosed. The configurable steel form system can be used to create precast panels for both commercial tilt panels and highway noise barrier walls, among other applications. A plurality of steel form system sections are preferably fabricated from steel plate bent into a J-channel member. The configurable steel form system can be designed in sections that are quickly assembled. To suit a particular application, a section can be extended by sequentially attaching extension members to a primary member. A quick-release mechanism can be implemented for ease and speed of connection. Each section can have the panel depth and contour fabricated into the steel form profile. Anchoring holes and corner miters can also be cut into the form's framework.

4 Claims, 10 Drawing Sheets

(56) References Cited

U.S. PATENT DOCUMENTS 2,098,929 A * 11/1937 Barnes ..... B28B 7/0014 264/157
2,251,775 A * 8/1941 Arrighini ..... E04G 13/00 249/34
2,663,925 A * 12/1953 Yates ..... E01C 19/502 249/6
2,793,416 A * 5/1957 Yearling ..... E01C 19/502 249/6
2,875,500 A * 3/1959 Stough ..... E01C 19/502 249/6
2,886,876 A * 5/1959 Wilson ..... B28B 7/42 249/13
2,902,742 A * 9/1959 Matich ..... E01C 11/14 249/3
2,917,803 A * 12/1959 Phillips ..... E01C 19/502 249/6
3,034,613 A * 5/1962 Heltzel ..... E01C 19/502 403/22
3,193,242 A 7/1965 Tumey et al.
3,242,833 A * 3/1966 Sondheim ..... E01C 19/502 249/208
3,242,834 A * 3/1966 Sondheim ..... E04G 17/042 249/208
3,395,884 A * 8/1968 Laukala ..... E01C 19/506 249/4
4,042,205 A 8/1977 Herrell
4,418,884 A 12/1983 Schimmel
4,579,312 A * 4/1986 White ..... E01C 19/506 249/134
4,659,054 A * 4/1987 Allen ..... E01C 19/2035 249/207
4,712,764 A * 12/1987 White ..... E01C 19/502 249/134
5,015,117 A * 5/1991 Pawlicki ..... E04B 1/5831 403/300
5,766,645 A * 6/1998 Kaminski ..... B28B 7/0017 249/120
5,956,912 A 9/1999 Carter et al.
6,668,511 B2 * 12/2003 Xammar ..... E04G 13/023 249/1
6,676,102 B1 * 1/2004 Hambelton ..... E04G 13/023 249/155
6,865,859 B2 3/2005 Flathau
6,918,567 B2 * 7/2005 Ward ..... E04G 13/00 249/189
7,950,872 B2 * 5/2011 Radu, Jr. ..... E01F 1/00 249/160
8,025,267 B2 9/2011 Sladojevic et al.
8,104,737 B2 * 1/2012 Yli-Ayho ..... B28B 7/002 249/139
8,496,223 B2 7/2013 Sladojevic et al.
9,487,950 B2 * 11/2016 Sladojevic ..... B28B 7/0014
9,694,511 B2 7/2017 Sladojevic
9,751,236 B2 * 9/2017 Daul ..... B28B 7/02
2003/0042393 A1 3/2003 Osborn
2005/0061948 A1 3/2005 Brennan
2007/0051867 A1 3/2007 Knowles
2007/0145640 A1 * 6/2007 Jones ..... B28B 7/0017 264/299
2010/0000177 A1 * 1/2010 Sladojevic ..... E04G 11/06 52/742.15
2010/0155571 A1 6/2010 Sladojevic et al.
2010/0308203 A1 12/2010 Bald
2011/0186710 A1 * 8/2011 Radu, Jr. ..... E01F 1/00 249/2
2012/0056344 A1 3/2012 Richardson et al.
2012/0286134 A1 * 11/2012 Rojas Pimienta .. E04G 17/0652 249/192
2014/0318062 A1 10/2014 Richardson et al.

FOREIGN PATENT DOCUMENTS

DE 2348117 4/1975
DE 29608470 8/1996
GB 1566119 4/1980
GB 2036155 A * 6/1980 ..... E01C 19/502
WO 2008025050 A1 3/2008
WO WO2019170477 * 9/2019 ..... B28B 7/0014

* cited by examiner

CONFIGURABLE STEEL FORM SYSTEM FOR FABRICATING PRECAST PANELS

BACKGROUND

1. Field of the Invention

The present invention is generally related to steel form systems, and more specifically to systems and methods for creating configurable precast concrete panels.

2. Background of the Invention and Description of Related Art

Concrete panels have long been used in commercial construction projects. Due to the difficulty and expense associated with transporting the concrete panels from a fabrication facility to a worksite, the concrete panels are generally fabricated at the worksite. Conventional approaches generally suffer from the same drawbacks: they are wasteful, require unnecessary man-hours to erect, and require continued replacement cost.

Typical industry processes create frameworks made of lumber near a worksite, so concrete panels can be poured and cured. Wooden components are typically employed due to their low cost. However the wood can warp and produce uneven surface in a resulting concrete panel. The combination of concrete and wood results in problems. As the water bleeds out of the concrete, the wood absorbs the water exacerbating the warping and minimizing the number of uses. As wood is not rigid, the wooden framework also requires bracing, typically every twelve inches, to support the framework, resulting in additional expense. The wooden edges of the framework are also prone to chip. The complexity and manpower required to construct this wooden framework (cutting individual components, bracing the pieces, and fastening the components together) coupled with the extra equipment required to form such components, results in wasted man-hours and greater expense, to create a flawed product. Add in the tear down, removal resupplying of such a wooden framework and the waste is further multiplied. Further, a typical assembly time for such a wooden framework is approximately forty-five minutes.

Other approaches include the use of aluminum frameworks, but such frameworks are expensive and subject to work site theft due to their expense. Additional equipment is also required as the individual aluminum members must be cut and then assembled. Reuse is similarly difficult, with the added burden of dismantling the aluminum framework to remove the concrete panel, removing the bolts, and cleaning the components with a wire brush to remove the concrete residue.

SUMMARY

The present invention achieves technical advantages as a configurable steel form system for creating precast concrete panels. The modular form system can be used to create precast panels for both commercial tilt panels and highway noise barrier walls, among other applications. A plurality of steel form system sections are preferably fabricated from ⅛" or 3⁄16" steel plate bent into a J-channel member. The configurable steel form system can be designed in 10' sections that are quickly assembled with connectors to extend the length of a section. To suit a particular application, a section can be extended by sequentially attaching extension members to a primary member. In one embodiment the connector is a quick-release mechanism disposed on a connector plate for ease and speed of connection. Each section has the panel depth and contour fabricated into the steel form profile. The anchoring slots and corner miters are also cut into the form's framework. In another embodiment a plurality of members are configured to form precast concrete panels.

One exemplary embodiment of the invention discloses a configurable steel form system, comprising a plurality of sections, each section having a plurality of gusset ribs disposed within the section, wherein a first end of each of the sections is mitered; a first chamfer disposed along a top edge of a first side of each of the sections; and a second chamfer disposed along a bottom edge of a first side of each of the sections. The chamfered-side of a first section can be adapted to removably engage the mitered end of a second section. Three or more sections can be removably engaged to enclose an area configured to receive a material. One or more of the sections can be extended by removably engaging one or more unitary J-channel members to a second end of one or more sections.

Another exemplary embodiment of the invention discloses an extendable steel form section, including a first unitary J-channel member having a first connector plate disposed at a first end of the first member; and a second unitary J-channel member having a second connector plate disposed at a first end of the second member. The first connector plate can include a first connector hole and a receiver configured to receive the alignment pin, the second connector plate can include a second connector hole and an alignment pin. The first connector plate can releasably engage the second connector plate by insertion of the alignment pin into the receiver, to form a section. The section can also include an attachment mechanism configured to securably couple the first connector plate with the second connector plate. The attachment mechanism can be a bolt and a nut, a quick-release mechanism, or a bolt and a wing nut. Further, the section can be extended by releasably inserting the alignment pins of additional unitary J-channel members to into the receivers of the section. The unitary J-channel member can made of steel or other suitable material.

Yet another exemplary embodiment of the invention discloses a configurable steel form separation system, including: a first configurable steel form system including a plurality of sections, wherein three or more sections can be removably engaged to enclose a first area configured to receive a first material; a second configurable steel form system including a plurality of sections, wherein three or more sections can be removably engaged to enclose a second area configured to receive a second material; a first spacer tab can be disposed on the first configurable steel form system; a second spacer tab can be disposed on the second configurable steel form system; and a spacer can be configured to removably engage the first spacer tab and the second spacer tab and configured to maintain a predetermined distance between the first configurable steel form system and the second configurable steel form system. The sections can include a chamfer disposed on a first side of a first section, the first side configured to removably engage a mitered end of a second section. Each section can include a unitary J-channel member having a connector plate with a connector hole. One or more of the sections can be extended by removably engaging one or more unitary J-channel members to an end of one or more sections. A plurality of anchor holes can be disposed in each section. The chamfer can be a first chamfer disposed along a top edge of a first side of each of the sections or a second chamfer disposed along a bottom edge of a first side of each of the sections.

Other advantages will be apparent to those of ordinary skill in the art.

DETAILED DESCRIPTION

The preferred version of the invention presented in the following written description and the various features and advantageous details thereof are explained more fully with reference to the non-limiting examples included in the accompanying drawings and as detailed in the description which follows. Descriptions of well-known components and processes and manufacturing techniques are omitted so as to not unnecessarily obscure the principle features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

Figure 1:
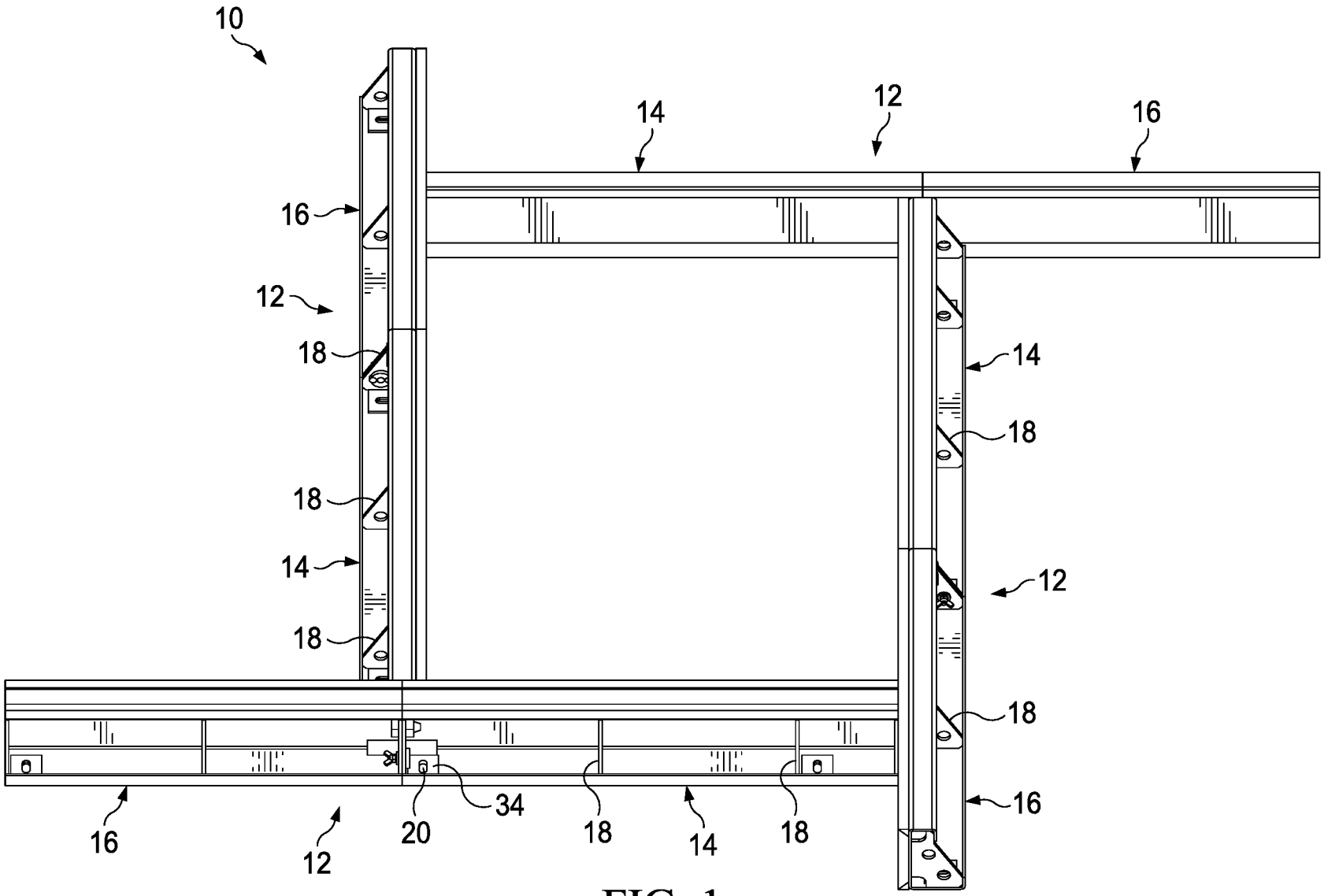
FIG. 1 is a perspective view of a configurable steel form system, in accordance with an embodiment of the present invention.

FIG. 1 is a perspective view of a configurable steel form system, designated generally as 10, in accordance with an embodiment of the present invention. The configurable steel form system 10 can be used to create precast concrete panels, sized to a particular application. The configurable steel form system 10 can include three or more sections 12. The section 12 requires a Form A member 14. However, one or more Form B members 16 can be securably coupled to the Form A member 14 to elongate the section 12 to size the section 12 for a particular application. In such a configuration, the Form A member 14 and the one or more Form B members 16, comprise a section 12.

A J-channel member forms the primary framework for both the Form A member 14 and the Form B member 16. The J-channel member can be fabricated using a unitary ⅛ or 3/16-inch steel plate bent into a figure "J" to form a J-channel within the J-channel member. The J-channel member preferably includes a 6" base, with a 6" first side upwardly extending from one end of the base and a 1½" second side upwardly extending from another end of the base. A 2" top side is formed by the portion of the J-channel member that extends, at a right angle, toward the second side, from the first side. However, the J-channel member can be fabricated using any suitable material and comprise any suitable size. The top of the J-channel member can include graduated markings to indicate length taken one or both ends of the J-channel member. The J-channel member can include a gusset rib 18, an anchor hole 20, an anchor plate 34, a chamfer 42, and a connector plate 26. A plurality of 3/16" steel plate gussets 18 can be disposed within the J-channel member at predetermined intervals (e.g., every 12"). The gussets 18 can be welded to the J-channel member, however, any suitable attachment process can be used. A plurality of ⅜" slotted, anchor holes 20 can be disposed within the bottom of the J-channel member. The anchor holes 20 can be slotted, having a length greater than a width. Alternatively, an anchor hole plate, having anchor holes 20, can be disposed over openings in the base of the J-channel member.

A chamfer 42 can be disposed along a top edge of a first side of each of the J-channel members. The chamfer 42 is preferably fabricated using ¾" steel. The chamfer can be comprised of angle moldings that trace a profile slope of a concrete panel. The chamfer 42 can be triangular, rounded, or of a varying shape. The chamfer 42 can be welded, or otherwise secured, to the J-channel member. A chamfer 42 can also be disposed along a bottom edge of a first side of each of the J-channel members. The chamfers can outwardly extend from the J-channel members to mold the edges of a concrete panel. Alternatively, the chamfers 42 can be selectively excluded on one or more sides of the system 10. The chamfers 42 are preferably welded to the J-channel member to provide secure, stable attachment to the first side of the J-channel member. The chamfers 42 are preferably triangular with one side securably coupled to the first side of the J-channel member and a second side extend outwardly to ¾" from the top of the J-channel member, and the hypotenuse tapering from the outermost point of the second side of the chamfer 42 to the bottommost point of the first side of the chamfer 42, which is attached to the J-channel member. The J-channel members can also include a connector plate 26 disposed on either side, or both of the J-channel member. The connector plate 26 is preferably fabricated using ⅜" steel. The connector plate 26 is held in place by the "J"-shape of the J-channel.

The J-channel member can include top and bottom tie-holes at certain intervals along the first side. The tie holes are preferably 1/18 inch holes disposed every six inches, but can be sized based upon the particular application. Plates can be used to stand the concrete panels or a welding plate for structural steel roof beams, such that a plurality of metal imbeds may exist in the concrete panel. A length of wire can secure the plates to a metal form. Accordingly, the plate can be positioned level with the steel form system 10 and the wire can be used to cross-tie the plate to maintain its position when the concrete is poured.

The Form A member 14 is preferably a system 10 receiver member formed using the J-channel member as a framework. The Form A member 14 has a mitered end on a first end of the Form A member 14 and alignment tubes disposed proximate the connector plate 26 on a second end of the Form A member 14. The Form A member 14 is preferably 10-feet, 6-inches (10' 6") long. The chamfer 42 of the Form A member 14 can have a 45-degree miter on one end, so to operably engage another Form A member 14 or Form B member 16 between top and bottom chamfers 42. The chamfers 42 preferably extend ¾" from the J-channel member. Such a length allows the mitered end of a Form A member 14 to securely engage a section 12, without the need of fasteners, clips, or other retaining mechanisms. However, any suitable chamfer length is possible. The mitered edges of the Form A member 14 are angled at the same angle as the chamfers 42 of Form A member 14 or Form B member 16, to securely engage the Form A member 14 to another Form A member 14 or a Form B member 16. The connector plate 42 of the Form A member 14 can have an alignment tube 30 disposed proximate the connector plate to create a flush side and extend away from the flush side within the J-channel member.

The Form B member 16 is preferably a 10-foot (10') long extension member. Connector plates 26 are disposed on both sides of the Form B member 16, to create a first and second end flush with the Form B member 16. The Form B member 16 can include alignment pins 28 outwardly extending from the connector plate 26 on a first end and an alignment tube 30 disposed proximate the connector plate and extending away from the flush side, within the Form B member 16. A Form B member 16 of any suitable material or sizing can be used.

The configurable steel form system 10 includes a plurality of sections 12 to form an enclosed area. As few as three sections 12 can be used to form a triangular concrete panel, but preferably, four sections 12 are incorporated to form rectangular concrete panels. However, additional sections 12 can be added to form pentagonal, hexagonal, heptagonal, octagonal, or any poly-sided concrete panel. Such configurations are made possible by at least the mitered-end of the Form A member 14, the stability of the chamfers 42, and the base of the J-channel member, all working together. Advantageously, by adding one or more Form B members 16 to a Form A member 14, the system 10 can be configured to form a concrete panel of any size.

In one exemplary application, four sections 12 are operatively engaged to form an enclosed area. Concrete can then be poured into the enclosed area to form a concrete panel. First, a protective layer must be placed on a casting bed to prevent the concrete from adhering to the casting bed surface. The protective layer can be a sheet, chemical (such as a bond-breaker liquid), or other suitable layer that can be disposed between the casting bed and the concrete.

A first section 12 can be disposed on a casting bed. The casting bed can be a concrete pad, or other suitable level surface. The first section 12 can be coupled to the concrete pad by drilling a hole into the pad, aligned with the anchor holes 20, and securing the section 12 to the pad with a bolt or other suitable device through the anchor holes 20. Due to the weight and durability of the section 12, adherence to the surface is not required, but can provide additional stability where needed. In, for example, industrial jobs, drilling may not be possible, accordingly, an adhesive, can be used to secure the section 12 to the pad, as needed. A second section 12 can be disposed perpendicular to the first section 12, such that the mitered end of the second section 12 engages the first section 12 to form a first corner. The second section 12 can be secured to the pad by drilling holes and inserting bolts through the anchor holes 20. A third section 12 is disposed perpendicular to the second section 12, such that the mitered end of the third section 12 engages the second section 12 to form a second corner. The second section 12 can be secured to the pad by drilling holes and inserting bolts through the anchor holes 20. A fourth section 12 is disposed perpendicular to the third section 12, such that the mitered end of the fourth section 12 engages the third section 12 to form a third corner. The fourth section 12 is also perpendicular to the first section 12, such that the mitered end of the first section 12 engages the fourth section 12 to form a fourth corner. The fourth section 12 can be secured to the pad by drilling holes and inserting bolts through the anchor holes 20.

The dimensions of the panel to be formed can be determined by the position of the corners as identified by the length from the mitered end of the section 12, such as with the graduated markings at the top of each J-channel member. If the desired panel length on a particular side of a section 12 exceeds the 10' 6" length of the section 12, consecutive Form B members 16 can be coupled to the section 12 to extend it to the desired length.

Figure 2A:
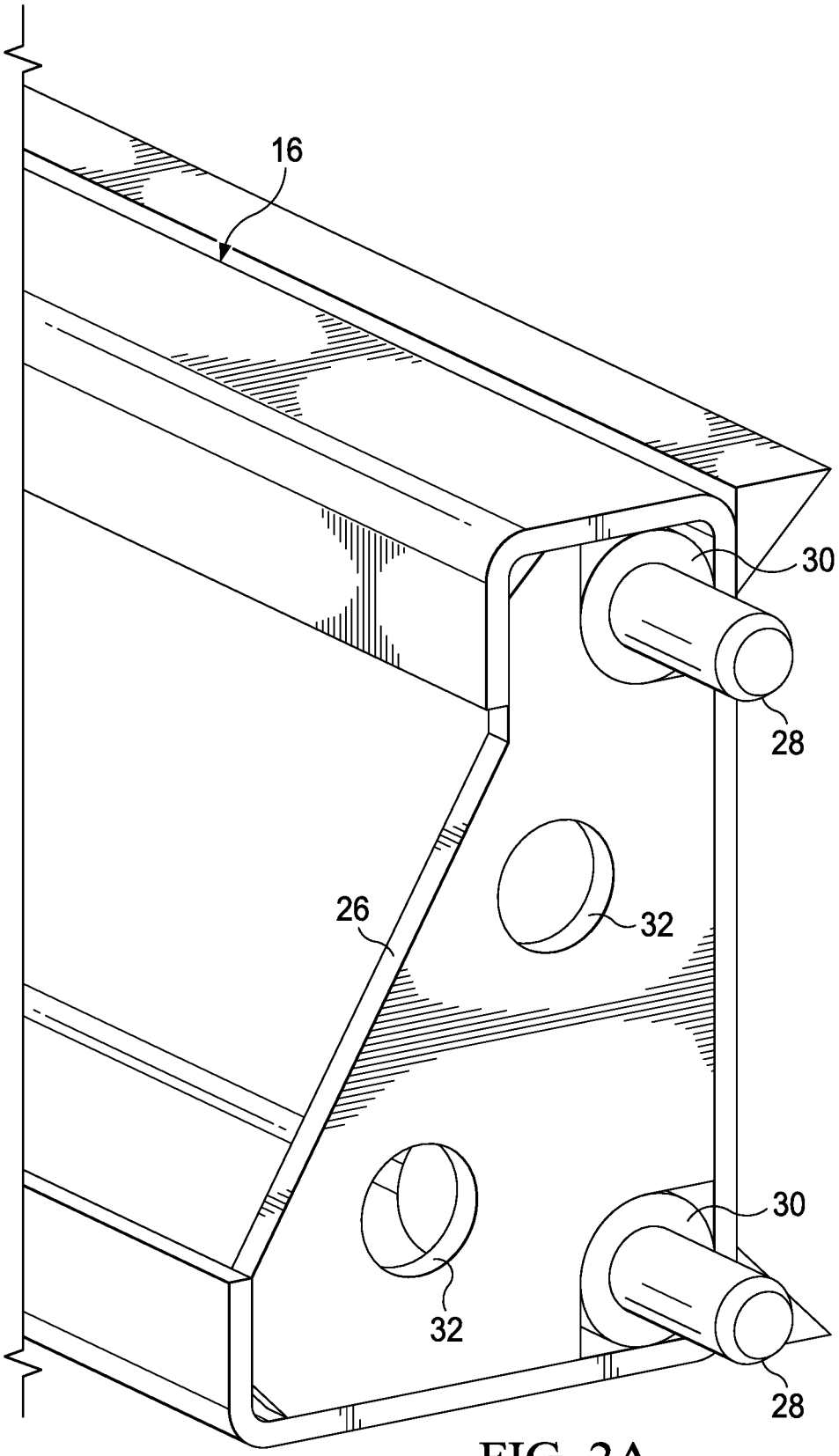
FIG. 2A is a perspective view of a first end of a Form B member, in accordance with an embodiment of the present invention.

Referring to FIG. 2A, there is shown a perspective view of a first end of a Form B member 16, in accordance with an embodiment of the present invention. The connector plate 26 is disposed on the first end of the Form B member 16, such that the connector plate 26 is flush with the first end of the Form B member 16. The Form B member 16 can include alignment pins 28 outwardly extending from the connector plate 26 on a first end. The alignment pin 28 can be securely coupled within an alignment tube 30 that can be securely coupled to the connector plate 26. The alignment pin 28, alignment tube 30, and connector plate 26 are preferably welded together, but any suitable coupling can be used. By disposing the alignment pin 28 within an alignment tube 30, the alignment pin 28 is reinforced such that the likelihood off snapping off the alignment pin 28 off of the connector plate 26 is greatly reduced. The form B member 16 can include one or more connector holes 32 disposed within the connector plate 26. The Form B member 16, the connector plate 26, and the alignment pins 28 are preferably made of steel, but any suitable material or sizing can be used.

Figure 2B:
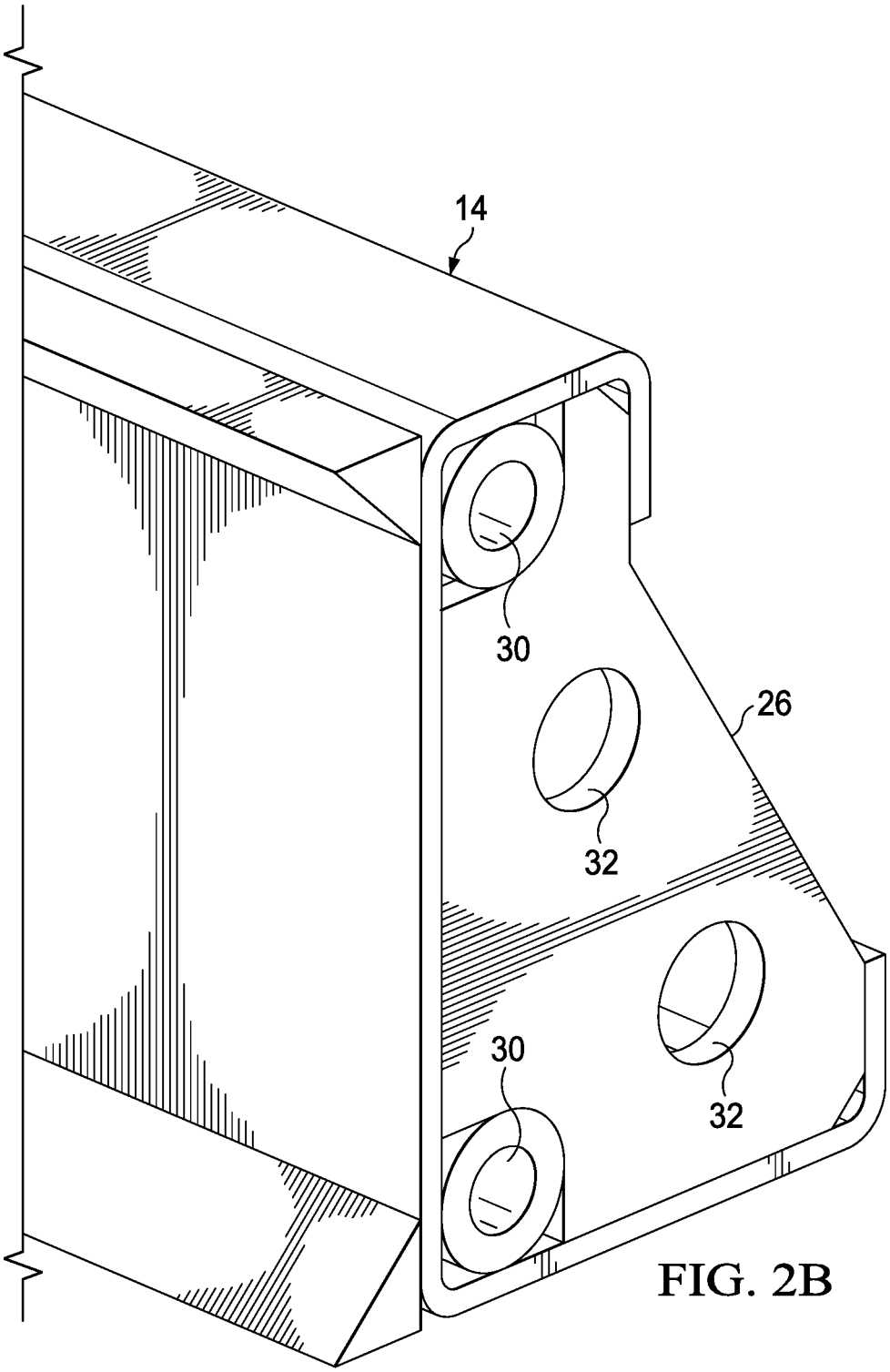
FIG. 2B is a perspective view of a second end of a Form A member, in accordance with an embodiment of the present invention.

FIG. 2B is a perspective view of a second end of a Form A member 14, in accordance with an embodiment of the present invention. The connector plate 26 is disposed on the second end of the Form A member 14, such that the connector plate 26 is flush with the second end of the Form A member 14. The Form A member 14 can include alignment tubes 30 disposed proximate the connector plate and extending within the Form A member 14. The Form A member 14 can include one or more connector holes 32 disposed within the connector plate 26. The Form A member 14, the connector plate 26, and the alignment pins 28 are preferably made of steel, but any suitable material or sizing can be used. The alignment tube 30 can be securely coupled to the connector plate 26. The alignment tube 30 and connector plate 26 are preferably welded together, but any suitable coupling can be used.

Figure 2C:
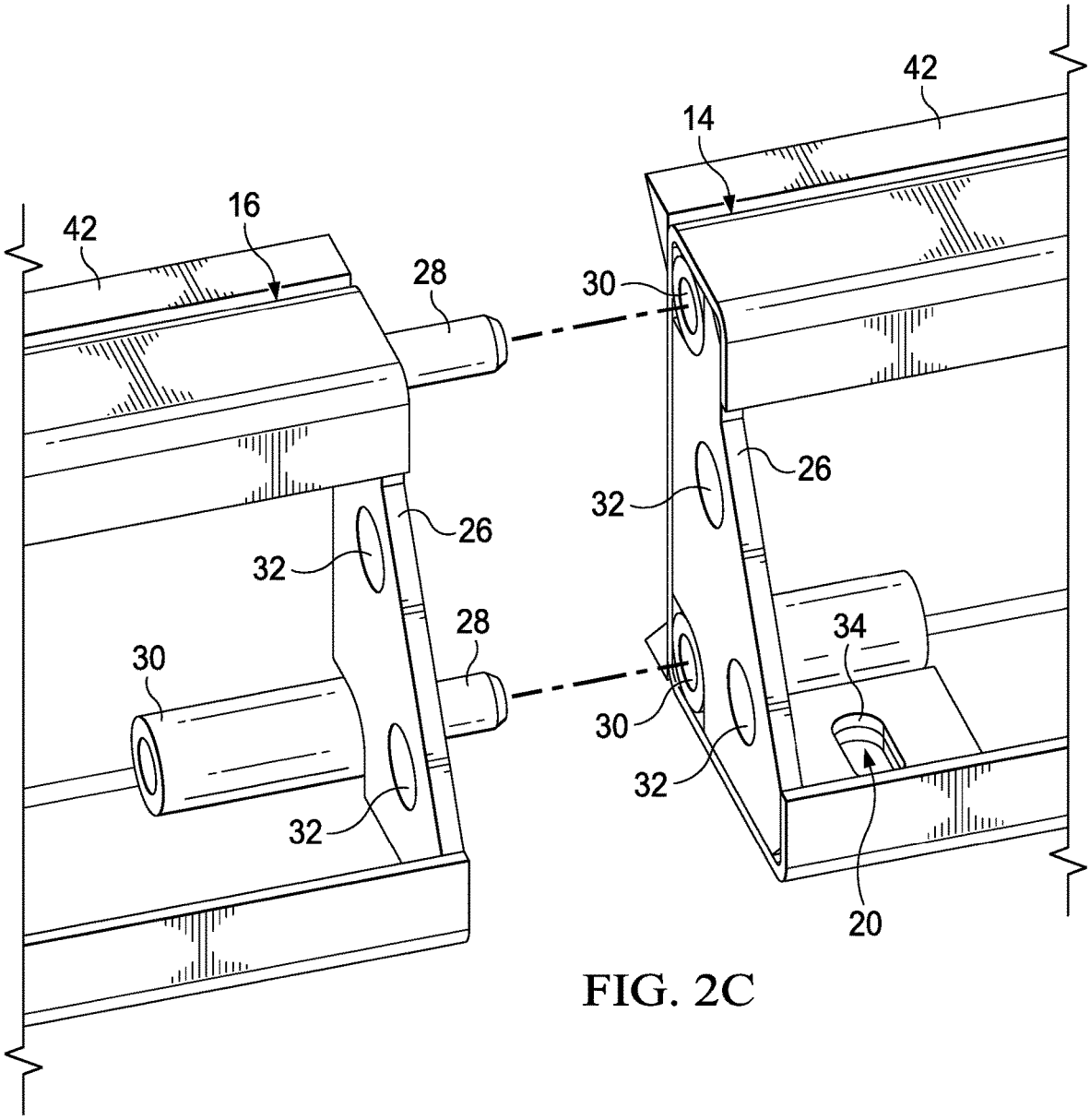
FIG. 2C is a perspective view of a first end of a Form B member aligned with a second end of a Form A member, for formation of a section, in accordance with an embodiment of the present invention.

FIG. 2C is a perspective view of a first end of a Form B member 16 aligned with a second end of a Form A member 14, for formation of a section, in accordance with an embodiment of the present invention. The Form A member 14 has alignment tubes 30 disposed proximate the connector plate 26 on a second end of the Form A member 14. The alignment pins 28 on the first end of the Form B member 16 are aligned with the alignment tubes 30 on the second end of the Form A member 14. The connector holes 32 of the second end of the Form A member 14 align with the connector holes 32 of the first end of the Form B member 16, such that a securing mechanism can be disposed therethrough to securely couple the connector plate 26 of the Form A member 14 with the connector plate of the Form B member 16. The securing mechanism is preferably a bolt and a nut, however, any suitable securing mechanism can be used. In this manner, additional Form B members 16 can be aligned, attached, and secured to second ends of the Form B member 16 shown in FIG. 2C to create a section of any length.

Figure 3A:
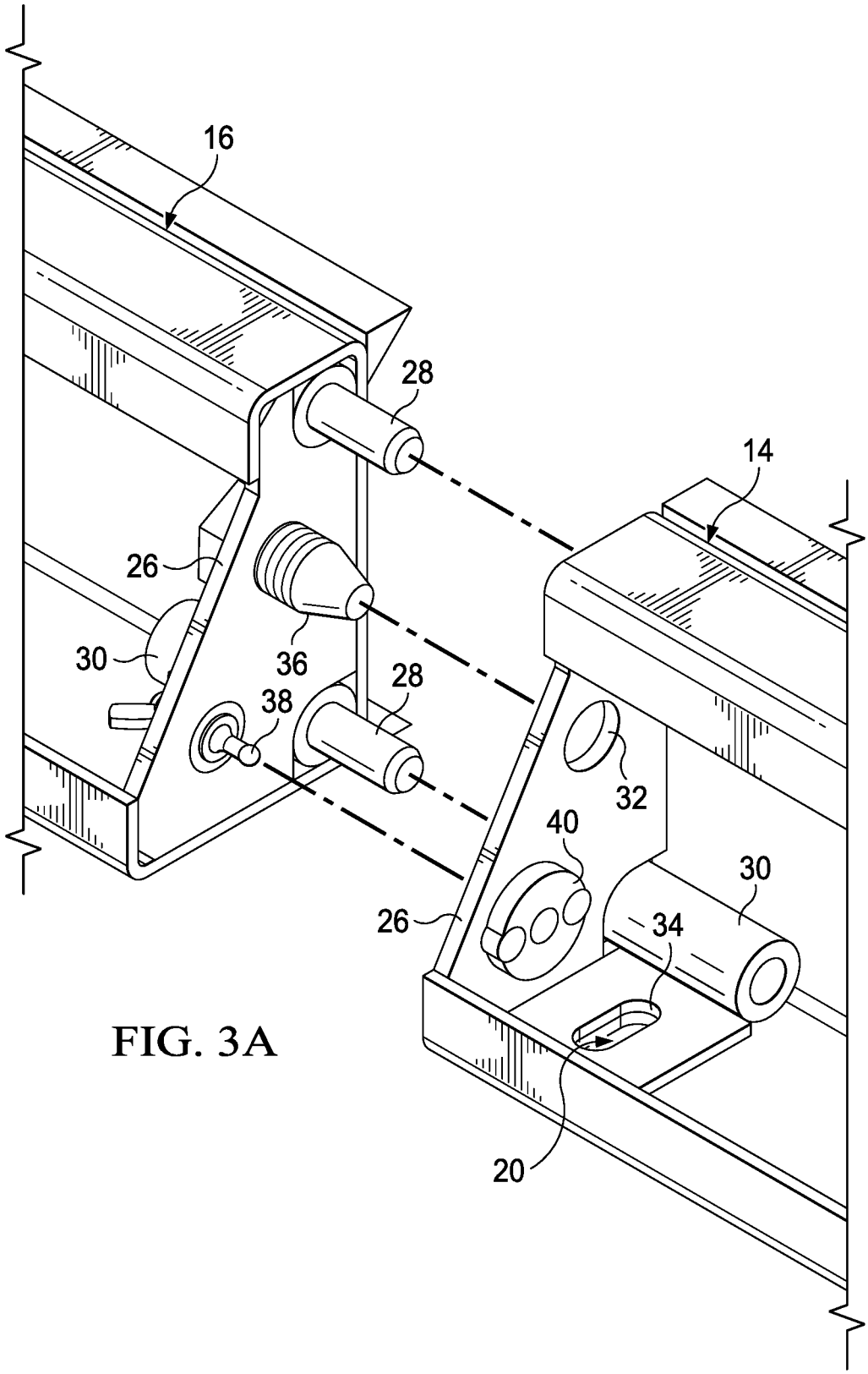
FIG. 3A is a perspective view of a first end of a Form B member aligned with a second end of a Form A member, for formation of a section, in accordance with another embodiment of the present invention.

FIG. 3A is a perspective view of a first end of a Form B member aligned with a second end of a Form A member, for formation of a section, in accordance with another embodiment of the present invention. The Form A member 14 has alignment tubes 30 disposed proximate the connector plate 26 on a second end of the Form A member 14. The alignment pins 28 on the first end of the Form B member 16 are aligned with the alignment tubes 30 on the second end of the Form A member 14. The connector holes 32 of the second end of the Form A member 14 align with the connector holes 32 of the first end of the Form B member 16, such that a securing mechanism can be disposed therethrough to securely couple the connector plate 26 of the Form A member 14 with the connector plate of the Form B member 16.

The securing mechanism is preferably a bolt and a nut, however, any suitable securing mechanism can be used. A bolt 36 is shown disposed in a first connector hole 32 of the connector plate of the Form B member 16. The securing mechanism can also be a quick-connect system, including a quick-connect pin 38 and a quick-connect receiver 40. The quick-connect pin 38 is preferably coupled to the connector plate 26 by a wing-nut, however alternative coupling mechanisms, such as traditional nuts, welding, or other suitable coupling techniques can be utilized. The quick-connect pin 38 preferably includes a shaft and a tip. The tip can have a greater diameter than the shaft. The quick-connect receiver 40 preferably includes a lever to selectively engage and release the tip of the quick-connect pin 38, however, any suitable mechanism to selectively engage and release the tip of the quick-connect pin 38 can be implemented. Advantageously, the quick-connect system can further reduce section setup time. Although the present embodiment discloses a single nut and bolt and a single quick-connect system, any combination or single usage of one nut and bolt, two nuts and bolts, one quick-connect system, two quick-connect systems can be implemented.

In this manner, additional Form B members 16 can be aligned, attached, and secured to second ends of the Form B member 16 shown in FIG. 2C to create a section of any length.

Figure 3B:
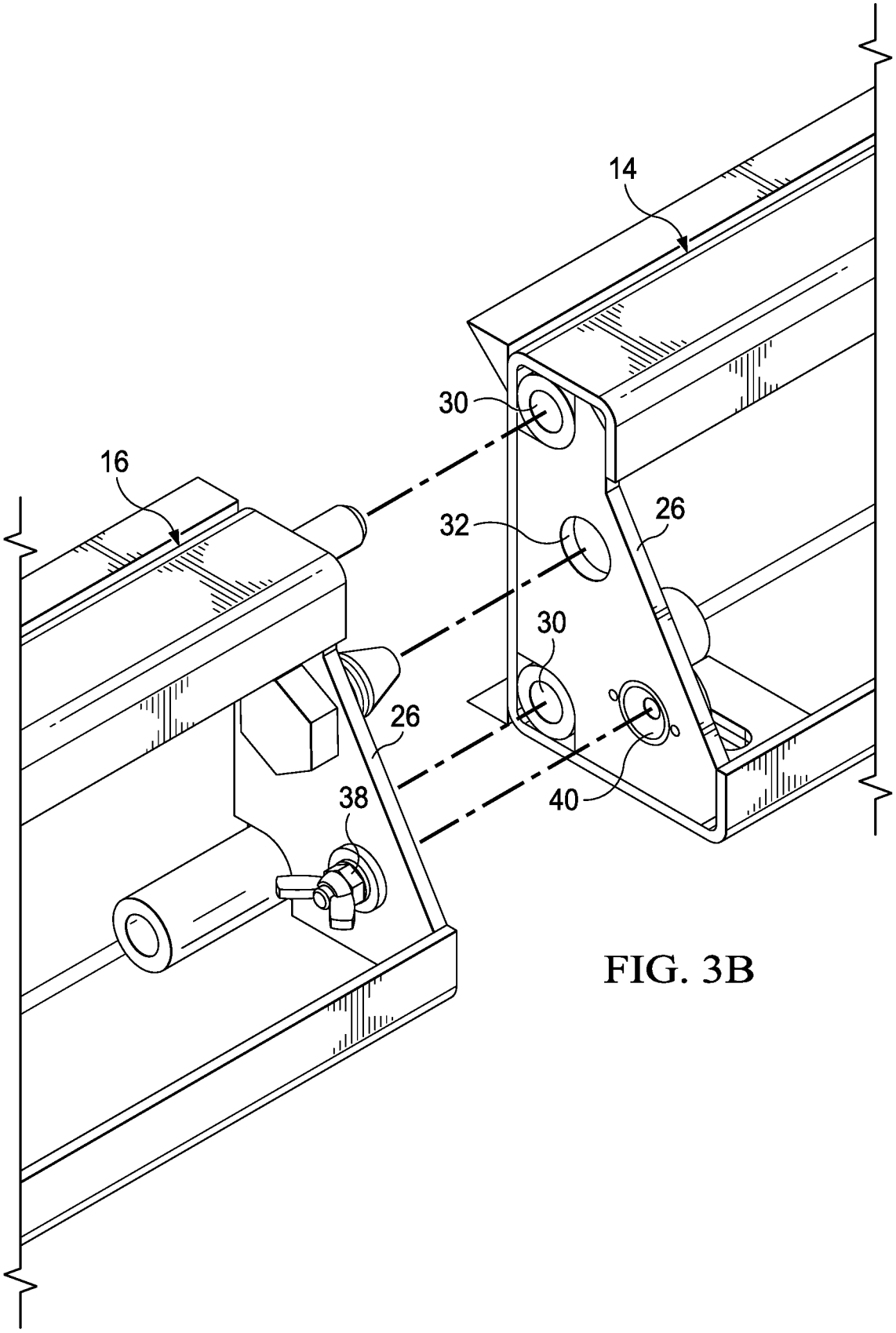
FIG. 3B is a perspective view of a second end of a Form A member aligned with a first end of a Form B member, for formation of a section, in accordance with another embodiment of the present invention.

FIG. 3B is a perspective view of a second end of a Form A member aligned with a first end of a Form B member, for formation of a section, in accordance with another embodiment of the present invention. As seen from a different perspective, the Form A member 14 has alignment tubes 30 disposed proximate the connector plate 26 on a second end of the Form A member 14. The alignment pins 28 on the first end of the Form B member 16 are aligned with the alignment tubes 30 on the second end of the Form A member 14. The connector holes 32 of the second end of the Form A member 14 align with the connector holes 32 of the first end of the Form B member 16, such that a securing mechanism can be disposed therethrough to securely couple the connector plate 26 of the Form A member 14 with the connector plate of the Form B member 16.

Figure 3C:
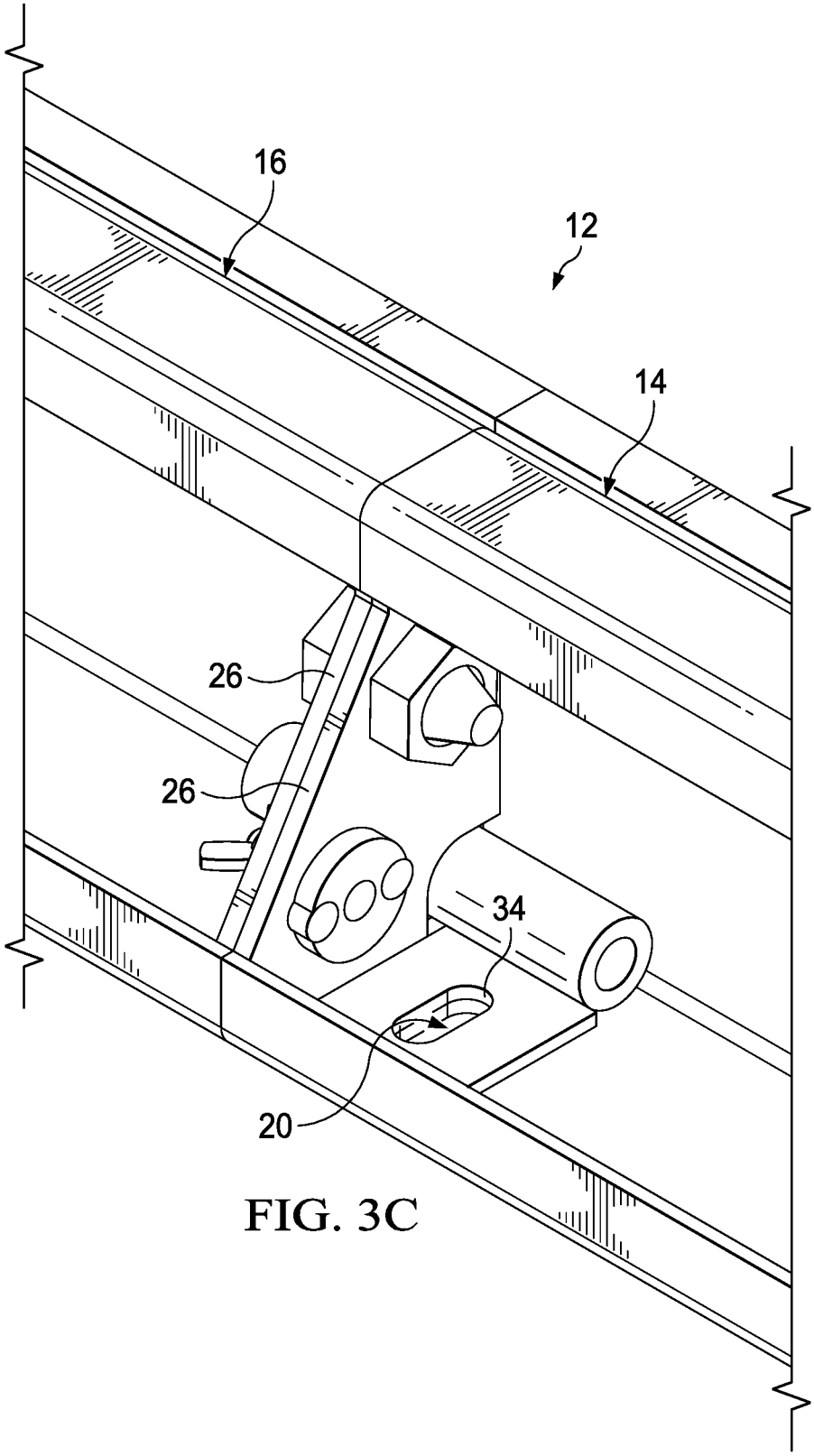
FIG. 3C is a perspective view a first end of a Form B member coupled with a second end of a Form A member, to form a section, in accordance with another embodiment of the present invention.

FIG. 3C is a perspective view a first end of a Form B member coupled with a second end of a Form A member, to form a section, in accordance with another embodiment of the present invention. When the Form A member 14 is coupled to the Form B member 16, the connector plates 26, the second end of the Form A member 14, and the first end of the Form B member 16 are flush so that a continuous section 12 is formed. By having two connector plates disposed next to each other at the coupling location reinforces the coupling such that the coupling is secure. The chamfers are also aligned such that, although a plurality of members may be connected to create a section 12 of a desired length, section 12 substantially appears to be a single member, as the member heights, chamfer lengths can be same.

Figure 4:
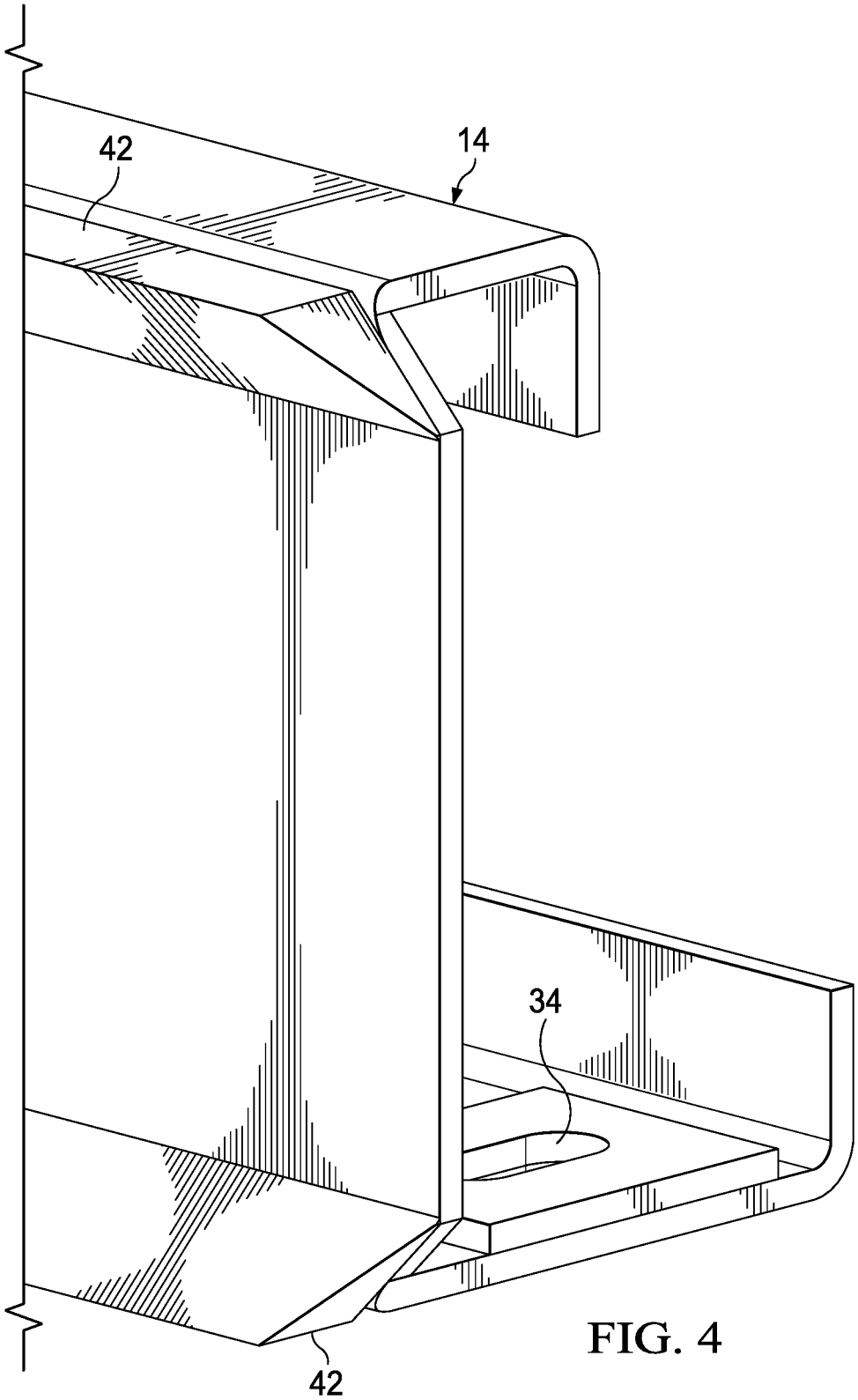
FIG. 4 is a perspective view of a mitered first end of a Form A member, in accordance with an embodiment of the present invention.

FIG. 4 is a perspective view of a mitered first end of a Form A member 14, in accordance with an embodiment of the present invention. The first end of the Form A member 14, is preferably inwardly mitered at a 45 degree angle from the first end of the Form A member 14. The chamfer is also preferably inwardly mitered at a 45 degree angle from the first end of the Form A member 14. Alternatively, the miter angles can be 30 degrees, 60 degrees, or any suitable angle. The miter of the first end of a Form A member 14 begins at the bottom edge of the chamfer 42. This is so the first end of a Form A member 14 can engage a first side of a section 12 and the first sides and chamfers of all utilized sections can form a concrete panel of specified dimensions having uniform edges circumscribing the top and bottom edges on the concrete panel.

Figure 5:
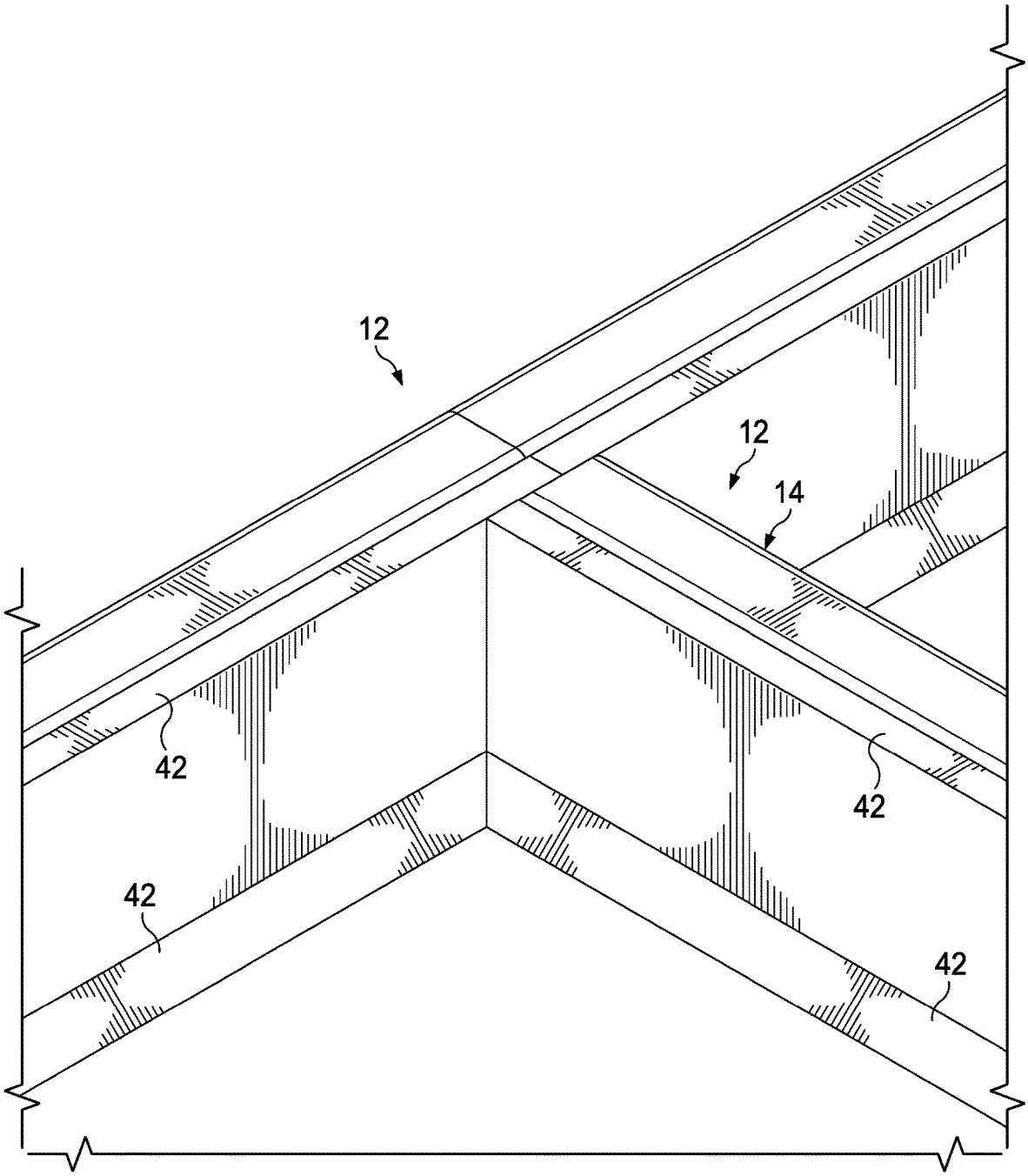
FIG. 5 is a perspective view of a corner of the configurable steel form system, in accordance with an embodiment of the present invention.

FIG. 5 is a perspective view of a corner of the configurable steel form system, in accordance with an embodiment of the present invention. As discussed above, the first end of a Form A member 14 can engage a first side of a section 12. Since the mitered end of the Form A member 14 is mitered at the same angle as the angle that the hypotenuse of the chamfer 42 diverges from the first end of the J-channel member, the mitered end of the Form A member 14 can engage the first end of the section 12 to form a fit with chamfer-to-chamfer contact of both the top and bottom chamfers of each section 12. The wide base of the J-channel member provides a stable foundation for a first section 12 to engage a second section 12. The sections 12 can be secured in place by the use of a bolt or other suitable securing means into the casting bed through the anchor holes 20.

Figure 6:
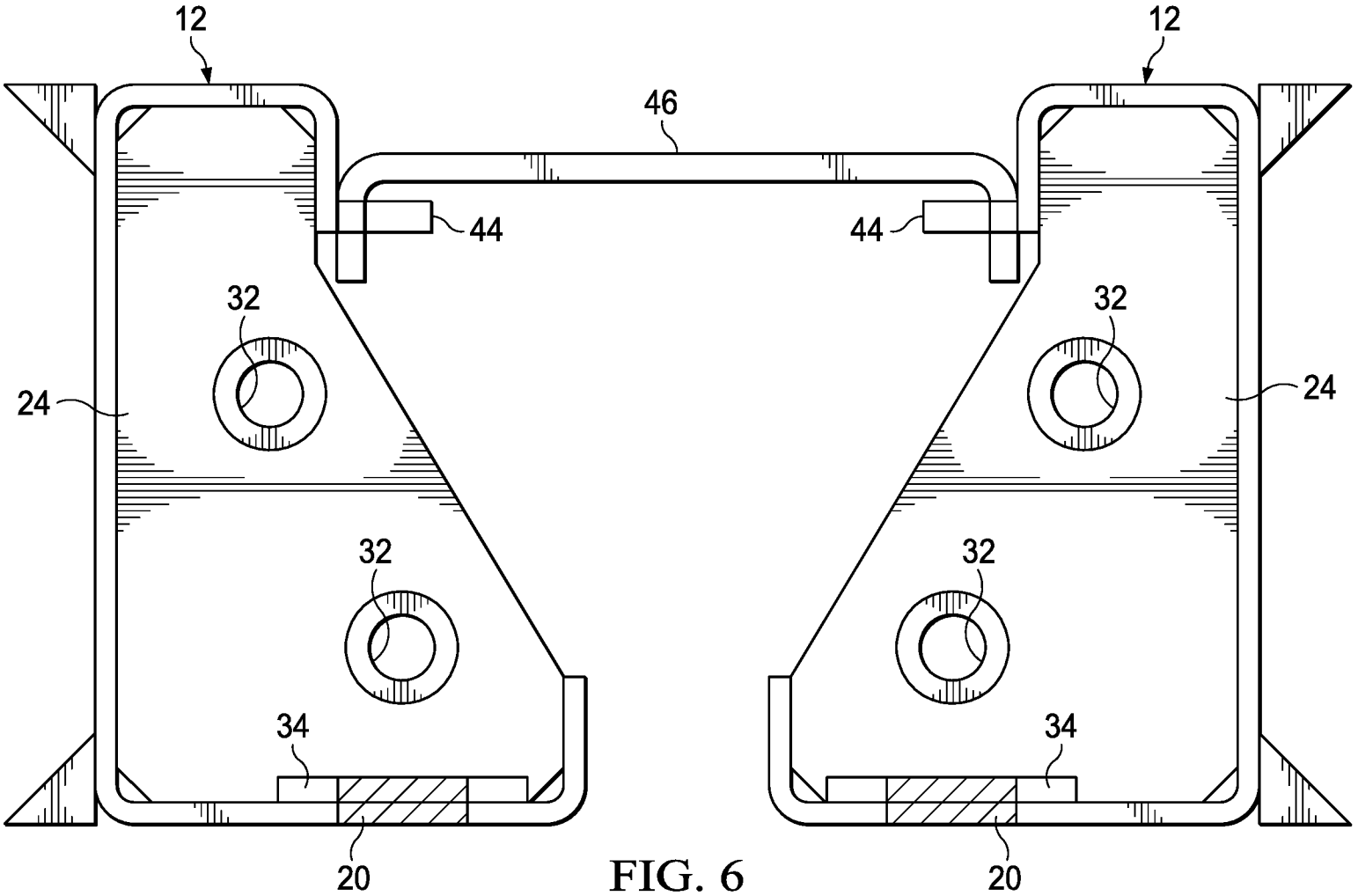
FIG. 6 is a cross-sectional view of two panels of a configurable steel form separation system, in accordance with an embodiment of the present invention.

FIG. 6 is a cross-sectional view of two sections of a configurable steel form separation system, in accordance with an embodiment of the present invention. In large applications, multiple concrete panels may need to be formed simultaneously to supply a particular job. However, the casting bed area may be substantial enough to allow for large distances between the sections 12 of a plurality of configurable steel form systems 10. In such environments, the steel form systems 10 are placed as close together as possible. Typically, all of the steel form systems 10 that can fit on the casting bed are setup and then the concrete is poured. If the steel form systems 10 are placed too close together, a first steel form system 10 will not be able to be removed from its concrete panels as it will abut a second steel form system 10 proximate to it. Additionally, the base of a J-channel member can be sized to conserve space on a particular casting bed.

As such, the J-channel member can include a spacer tab 44. The spacer tab 44 can be made of metal, or any suitable material and outwardly extend from the second side of the J-channel member. The spacer tab 44 preferably includes a spacer opening disposed therein. The spacer tab 44 can be securably attached to the second side of the J-channel member at predetermined locations via weld, adhesive, screw, or other suitable attachment processes.

A spacer 46 can be a bar having a predetermined length with 90-degree bends on both ends of the spacer 46. The spacer 46 is preferably made of metal and 1½" long, but can be made of any suitable material and sized to any length. A first end of the spacer 46 can be adapted to removably engage the spacer opening in the spacer tab 44 coupled to a section 12 of a first steel form system 10 and a second end of the spacer 46 can be adapted to removably engage the spacer opening in the spacer tab 44 coupled to a section 12 of a second steel form system 10.

The present invention achieves at least the following advantages:

1. significant cost savings by eliminating waste associated with the fabrication process;
2. balance of durability and ease of use;
3. given a concrete panel crew with a heavy workload, conservatively, approximately seven workers are required over the course of twelve days with the present invention, versus twelve workers over fifteen days for wooden framework setup;
4. creates a fitted corner;
5. can be used for stackable cement pours;
6. modular and configurable;
7. single frame embodiment;
8. reusability,
9. dimensional adaptability;
10. securable to casting surface with adhesive in lieu of anchors.

While the invention has been shown in one of its forms, it is not thus limited and is susceptible to various changes and modifications without departing from the spirit thereof. Persons skilled in the art will understand that this concept is susceptible to various changes and modifications, and may be implemented or adapted readily to other types of environments. Further, the individual elements of the claims are not well-understood, routine, or conventional. Instead, the claims are directed to the unconventional inventive concept described in the specification.

What is claimed is:

1. A configurable steel form system, comprising:

a plurality of sections, each section having a plurality of gusset ribs disposed within the section, wherein a first end of each of the sections is mitered;

a first chamfer disposed along a top edge of a first side of each of the sections; and a second chamfer disposed along a bottom edge of a first side of each of the sections, wherein the chamfered-side of a first section is adapted to removably engage the mitered end of a second section, wherein three or more sections are removably engaged to enclose an area configured to receive a material;

wherein the sections are formed using one or more unitary J-channel members.

2. The system of claim 1, wherein the unitary J-channel members are made of steel.

3. The system of claim 2, wherein one or more of the sections can be extended by removably engaging one or more unitary J-channel members to a second end of one or more sections.

4. The system of claim 2, wherein a plurality of anchor holes are disposed in each section.

* * * * *